US010753199B2

(12) United States Patent
Khan

(10) Patent No.: US 10,753,199 B2
(45) Date of Patent: Aug. 25, 2020

(54) ROTATING CONTROL DEVICE WITH COMMUNICATIONS MODULE

(71) Applicant: Halliburton Energy Services, Inc., Houston, TX (US)

(72) Inventor: Jameel A. Khan, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 159 days.

(21) Appl. No.: 15/781,409

(22) PCT Filed: Jan. 13, 2016

(86) PCT No.: PCT/US2016/013281
§ 371 (c)(1),
(2) Date: Jun. 4, 2018

(87) PCT Pub. No.: WO2017/123222
PCT Pub. Date: Jul. 20, 2017

(65) Prior Publication Data

US 2018/0363455 A1 Dec. 20, 2018

(51) Int. Cl.

| | |
|---|---|
| ***E21B 47/13*** | (2012.01) |
| ***E21B 33/035*** | (2006.01) |
| ***E21B 47/12*** | (2012.01) |
| ***E21B 33/08*** | (2006.01) |
| *E21B 47/07* | (2012.01) |
| *E21B 17/08* | (2006.01) |
| *E21B 47/06* | (2012.01) |

(52) U.S. Cl.
CPC ..... *E21B 47/13* (2020.05); *E21B 33/035* (2013.01); *E21B 33/085* (2013.01); *E21B 17/085* (2013.01); *E21B 47/06* (2013.01); *E21B 47/07* (2020.05)

(58) Field of Classification Search
CPC ..... E21B 33/085; E21B 47/12; E21B 47/122; E21B 33/035; E21B 47/13
See application file for complete search history.

(56) References Cited

U.S. PATENT DOCUMENTS

| | | | | |
|---|---|---|---|---|
| 5,755,372 | A | 5/1998 | Cimbura, Sr. | |
| 8,931,549 | B2 * | 1/2015 | Smith | E21B 47/122 166/65.1 |
| 9,249,646 | B2 * | 2/2016 | Hannegan | E21B 33/16 |
| 10,280,743 | B2 * | 5/2019 | Khan | E21B 33/085 |

(Continued)

FOREIGN PATENT DOCUMENTS

| | | |
|---|---|---|
| EP | 0304141 | 2/1989 |

OTHER PUBLICATIONS

International Search Report and Written Opinion of PCT Application No. PCT/US2016/013281 dated Sep. 29, 2016: pp. 1-18.

*Primary Examiner* — Catherine Loikith
(74) *Attorney, Agent, or Firm* — Chamberlain Hrdlicka

(57) ABSTRACT

A rotating control device includes a housing comprising a bore extending through the housing, a rotating body positioned within the bore of the housing and rotatable with respect to the housing and a packer assembly positioned within the bore of the housing between the housing and the rotating body and configured to form a seal between the housing and the rotating body. The device further includes a transmitter configured to transmit a sensor signal through the packer assembly and a receiver configured to receive the sensor signal from the transmitter through the packer assembly.

18 Claims, 7 Drawing Sheets

(56) References Cited

U.S. PATENT DOCUMENTS

| | | | |
|---|---|---|---|
| 2008/0296016 | A1 | 12/2008 | Hughes et al. |
| 2010/0187015 | A1 | 7/2010 | Williams |
| 2015/0308253 | A1 | 10/2015 | Clark et al. |
| 2015/0315847 | A1 | 11/2015 | Gray et al. |

* cited by examiner

ROTATING CONTROL DEVICE WITH COMMUNICATIONS MODULE

BACKGROUND

This section is intended to provide background information to facilitate a better understanding of the various aspects of the described embodiments. Accordingly, it should be understood that these statements are to be read in this light and not as admissions of prior art.

Drilling a wellbore for hydrocarbons requires significant expenditures of manpower and equipment. Thus, constant advances are being sought to reduce any downtime of equipment and expedite any repairs that become necessary. Rotating equipment requires maintenance as the drilling environment produces forces, elevated temperatures and abrasive cuttings detrimental to the longevity of seals, bearings, and packing elements.

In a typical drilling operation, a drill bit is attached to a drill pipe. Thereafter, a drive unit rotates the drill pipe through a drive member, such as a kelly, as the drill pipe and drill bit are urged downward to form the wellbore. In some arrangements, a kelly is not used, thereby allowing the drive unit to attach directly to the drill pipe or tubular. The length of the wellbore is determined by the location of the hydrocarbon formations. In many instances, the formations produce fluid pressure that may be a hazard to the drilling crew and equipment unless properly controlled.

Several components are used to control the fluid pressure. Typically, one or more blowout preventers (BOP) are mounted with the well forming a BOP stack to seal the well. In particular, an annular BOP is used to selectively seal the lower portions of the well from a tubular that allows the discharge of mud. In many instances, a rotating control device or rotating control head is mounted above the annular BOP or the BOP stack. An inner portion or member of the rotating control device is designed to seal and rotate with the drill pipe. The inner portion or member typically includes at least one internal sealing element mounted with a plurality of bearings in the rotating control device.

During the drilling operation, the drill pipe or tubular is axially and slidably moved through the rotating control device. The axial movement of the drill pipe along with other forces experienced in the drilling operation, some of which are discussed below, causes wear and tear on the bearing and packer or seal assembly such that the rotating control device subsequently requires repair. Further, the thrust generated by the wellbore fluid pressure, the radial forces on the bearing assembly, and other forces cause a substantial amount of heat to build in the conventional rotating control device. The heat causes the seals and bearings to wear and subsequently require repair. Further, the rotating control device is normally used in the presence of drilling fluid, and in the case of offshore environments, seawater. These fluids can have a high salinity content and also be corrosive, further adding to the potential need to monitor and properly maintain the components of the rotating control device.

BRIEF DESCRIPTION OF THE DRAWINGS

For a detailed description of the embodiments of the invention, reference will now be made to the accompanying drawings in which.

DETAILED DESCRIPTION

Figure 1:
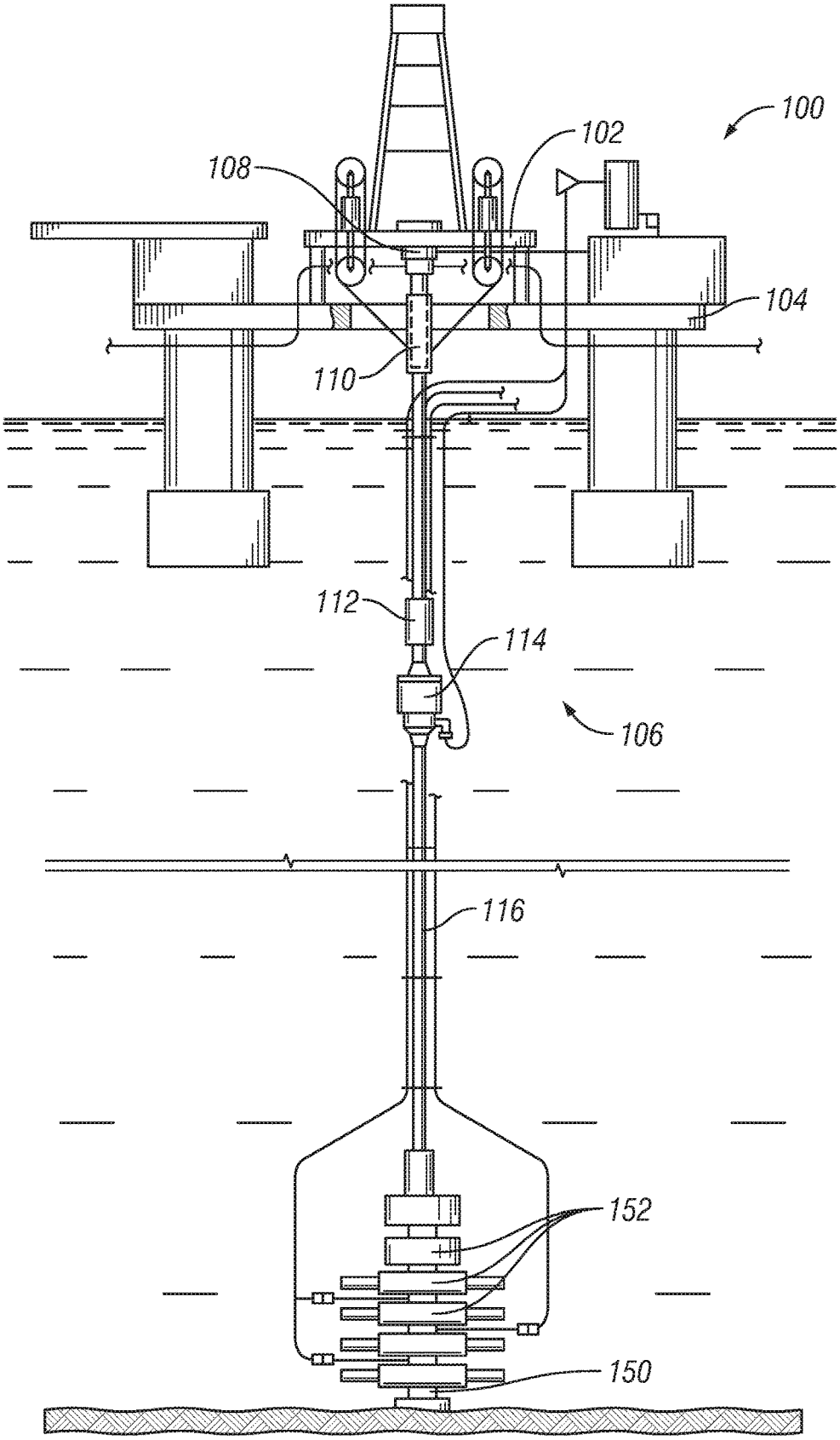
FIG. 1 depicts a schematic view of an example offshore drilling system, according to one or more embodiments.

Referring now to FIG. 1, a schematic view of an offshore drilling system including an offshore drilling platform 100 in accordance with one or more embodiments of the present disclosure is shown. While the offshore drilling platform 100 is depicted as a semi-submersible drilling platform, one of ordinary skill will appreciate that a platform of any type may be used including, but not limited to, drillships, spar platforms, tension leg platforms, and jack-up platforms. The offshore drilling platform 100 includes a rig floor 102 and a lower bay 104. A riser assembly 106 extends from a subsea wellhead 150 to the offshore drilling platform 100 and includes various drilling and pressure control components, such as one or more blowout preventers 152 that are positioned atop the subsea wellhead 150.

From top to bottom, the riser assembly 106 includes a diverter assembly 108, a slip joint 110, a rotating control device (RCD) 112, an annular blowout preventer 114, and a string of riser pipe 116 extending to the subsea wellhead 150. While one configuration of riser assembly 106 is shown and described in FIG. 1, one of ordinary skill in the art should understand that various types and configurations of riser assembly 106 may be used in conjunction with embodiments of the present disclosure. Specifically, it should be understood that a particular configuration of riser assembly 106 used will depend on the configuration of the subsea wellhead below, the type of offshore drilling platform 100 used, and the location of the well site.

Because the offshore drilling platform 100 is a semi-submersible platform, it is expected to have significant relative axial movement (i.e., heave) between its structure (e.g., rig floor 102 and/or lower bay 104) and the sea floor. Therefore, a heave compensation mechanism may be employed so that tension may be maintained in riser assembly 106 without breaking or overstressing sections of the riser pipe 116. As such, the slip joint 110 may be constructed to allow relative displacement and compensate for wave action experienced by drilling platform 100. Furthermore, a hydraulic member (not shown) may connect between the rig floor and the riser assembly 106 to provide upward tensile force to the string of the riser pipe 116, as well as to limit a maximum stroke of slip joint 110. To counteract translational movement (in addition to heave) of drilling platform 100, an arrangement of mooring lines (not shown) may be used to retain drilling platform 100 in a substantially constant longitudinal and latitudinal area.

In certain operations including, but not limited to drilling operations, the riser assembly 106 may be required to handle high annular pressures. However, components, such as diverter assembly 108 and slip joint 110, are typically not constructed to handle the elevated annular fluid pressures associated with drilling. Therefore, in selected embodiments, components in an upper portion of riser assembly 106 are isolated from the elevated annular pressures experienced by components located in a lower portion of riser assembly 106. Thus, the rotating control device 112 may be included in the riser assembly 106 between the riser string 116 and the slip joint 110 to rotatably seal about a drillstring positioned within the riser string 116 and prevent high pressure annular fluids in the riser string 116 from reaching the slip joint 110, the diverter assembly 108, and the environment.

In one embodiment, the rotating control device 112 may be capable of isolating pressures in excess of 1,000 psi while the drillstring is rotating (i.e., dynamic) and 2,000 psi when the drillstring is not rotating (i.e., static) from upper portions of the riser assembly 106. While the annular blowout preventer 114 may be capable of similarly isolating annular pressure, such annular blowout preventers are not intended to be used when the drillstring is rotating, as would occur during a drilling operation.

Figure 2:
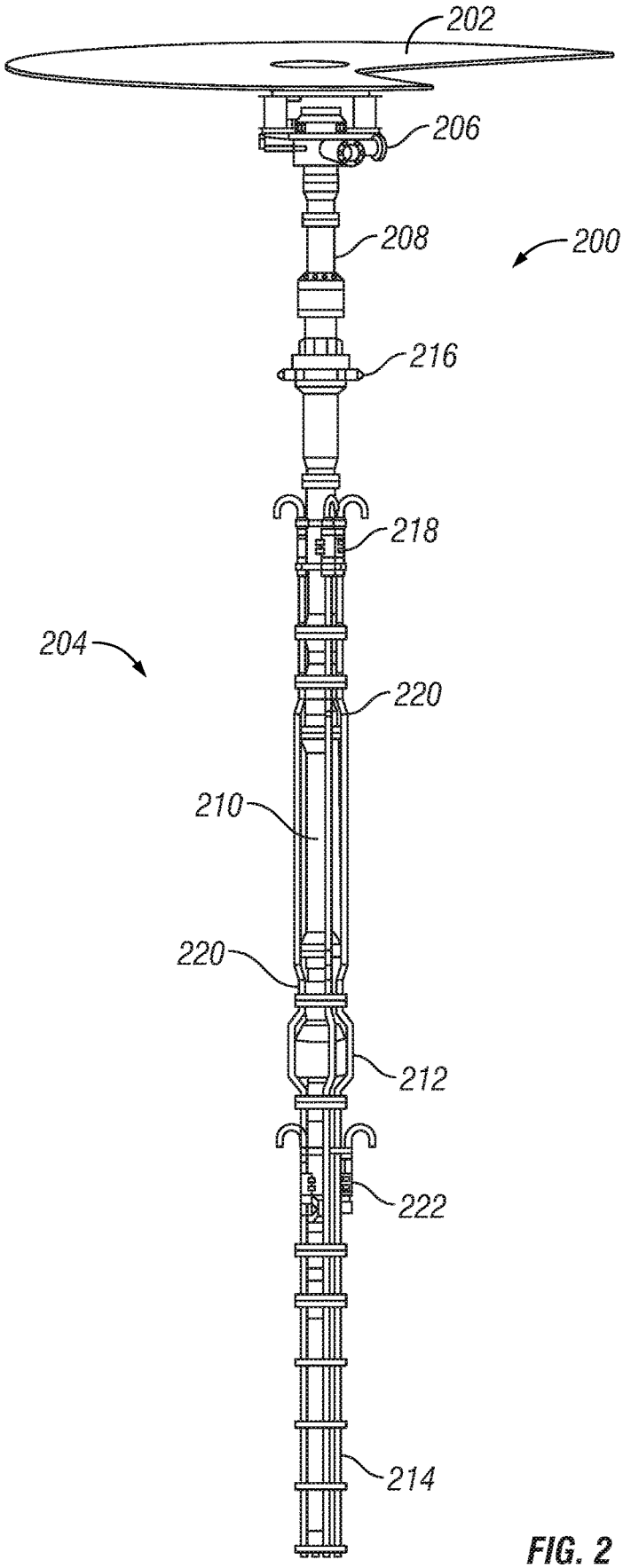
FIG. 2 depicts a perspective view of a portion of an example offshore drilling system, according to one or more embodiments.
Figure 3:
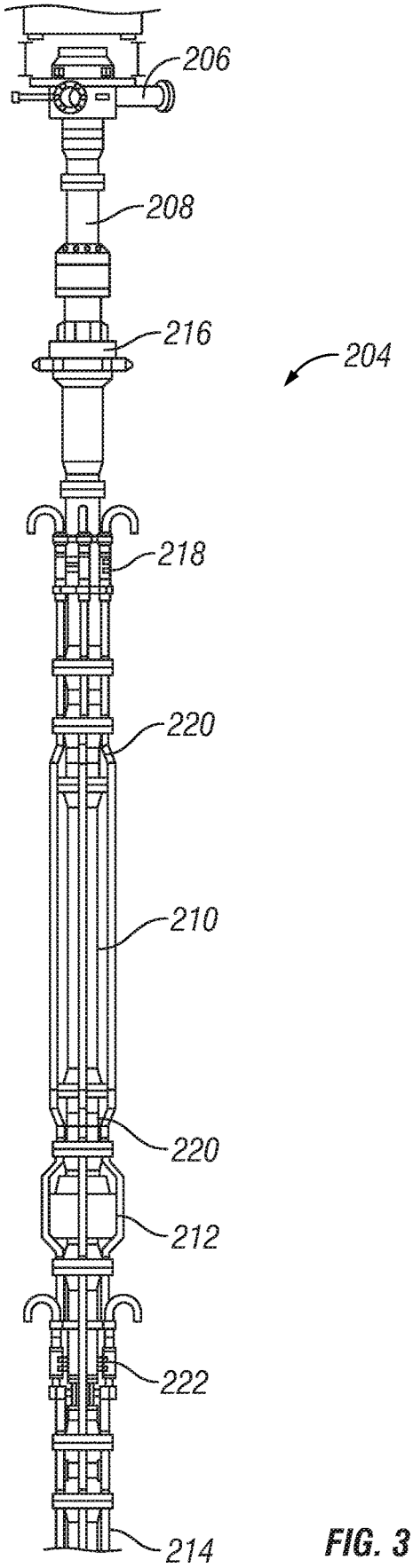
FIG. 3 depicts a perspective view of a portion of an example offshore drilling system, according to one or more embodiments.
Figure 4:
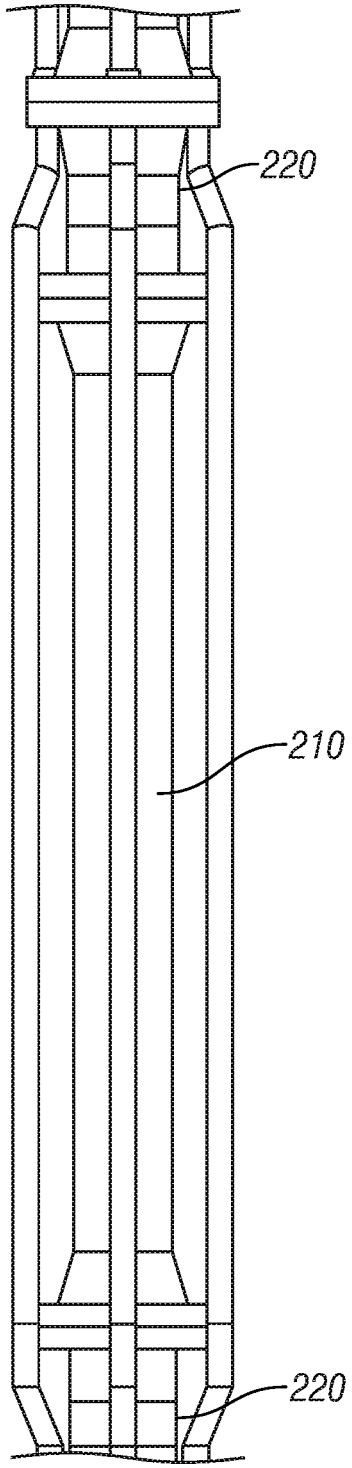
FIG. 4 depicts a perspective view of an example rotating control device, according to one or more embodiments.

Referring now to FIGS. 2-4, multiple views of portions of an offshore drilling system 200 in accordance with one or more embodiments of the present disclosure is shown. In particular, FIG. 2 shows a perspective view of the offshore drilling system 200 with reference to an offshore drilling platform 202, FIG. 3 shows a more detailed perspective view of the offshore drilling system 200, and FIG. 4 shows a more detailed view of a rotating control device 210 included within the offshore drilling system 200. The offshore drilling system 200 includes an offshore drilling platform 202 with a riser assembly 204 that is supported by and extends from the offshore drilling platform 202. In this embodiment, the riser assembly 204 includes a diverter assembly 206, a slip joint 208, a rotating control device 210, an annular blowout preventer 212, and a drilling riser 214 (e.g., string of riser pipe) extending to a subsea wellhead (not shown). The riser assembly 204 may further include a tension ring 216 and a termination joint 218 positioned between the rotating control device 210 and the platform 202, crossover joints 220 positioned on one or both sides of the rotating control device 210, and a rotating control device flow spool 222 positioned between the drilling riser 214 and the rotating control device 210 or blowout preventer 212.

Figure 5:
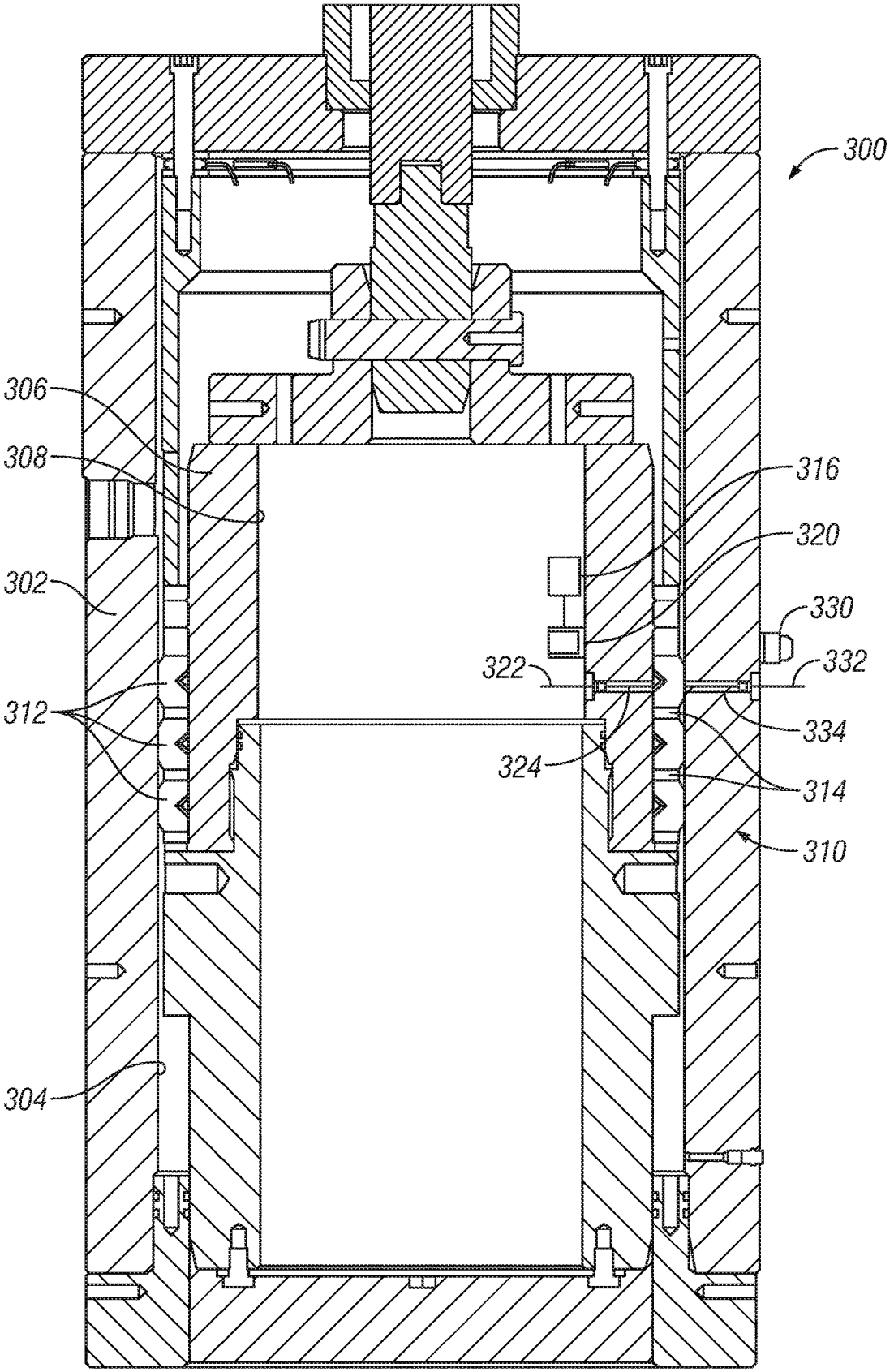
FIG. 5 depicts a cross-sectional view of an example rotating control device, according to one or more embodiments.
Figure 6:
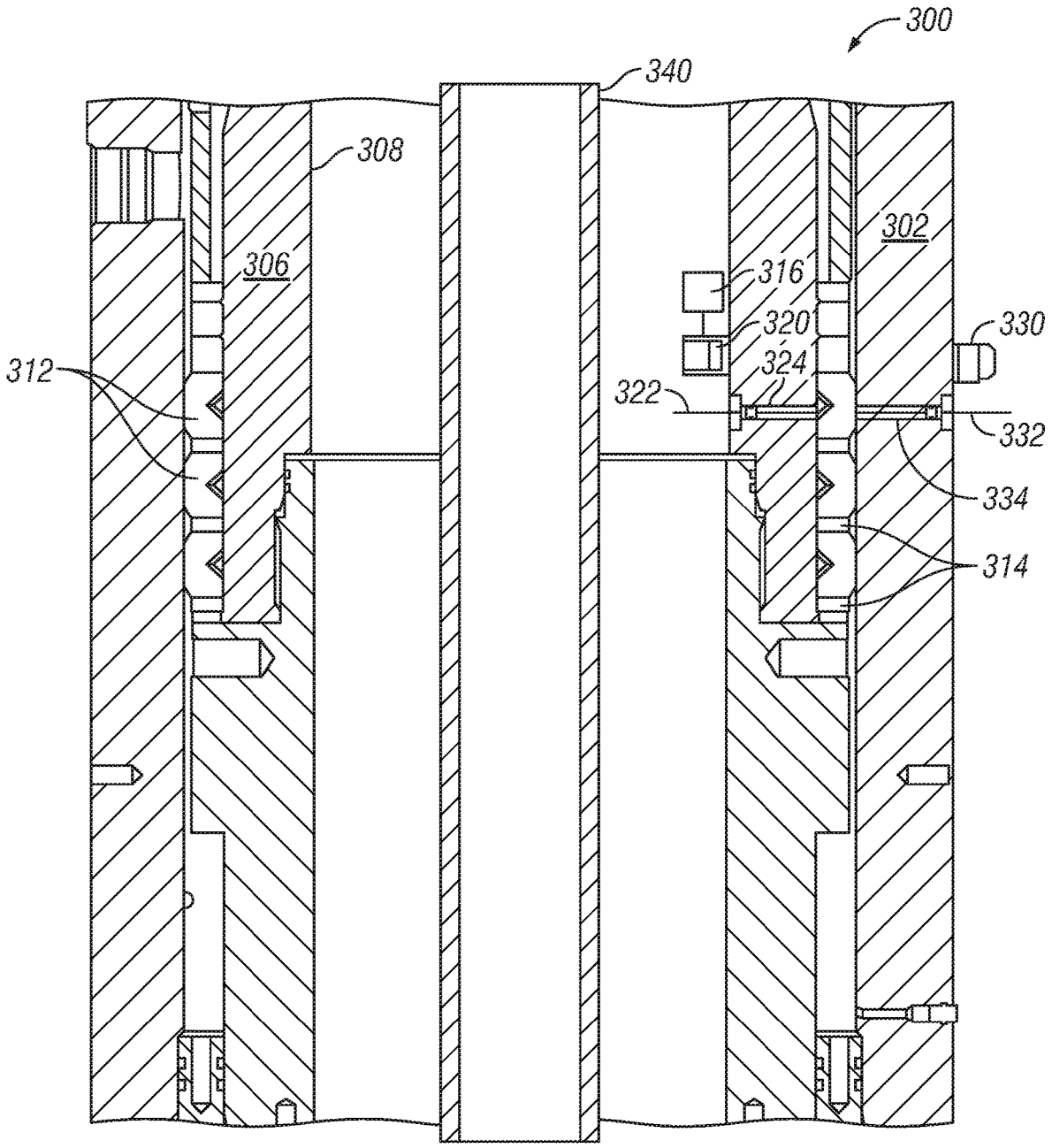
FIG. 6 depicts a cross-sectional view of an example rotating control device, according to one or more embodiments.

FIG. 5 is a cross-sectional view of a rotating control device 300 in accordance with one or more embodiments of the present disclosure. Further, FIG. 6 is a more detailed cross-sectional view of the rotating control device 300 with a drillstring 340 positioned therethrough in accordance with one or more embodiments of the present disclosure. The rotating control device 300 may be similar to the other rotating control devices discussed and mentioned above, but the rotating control device 300 may be used in a subsea or underwater environment. The rotating control device 300 may be included in a riser assembly, such as to rotatably seal about the drillstring 340 and prevent the flow of high pressure annular fluids in the riser assembly. Further, one or more sensors (discussed more below) and other electronic components, may be included within the rotating control device 300 to monitor the rotating control device 300 and communicate the status of the rotating control device 300, such as to the offshore drilling platform within an offshore drilling system.

In this embodiment, the rotating control device 300 includes a housing 302 that includes a bore 304 formed within and extending through the housing 302 about an axis extending through the housing. The bore 304 may receive the drillstring 340 during a drilling operation, and allows the drillstring 340 to advance through the rotating control device 300. A rotating body 306 (e.g., cylindrical spool or tubular) is positioned within the bore 304 of the housing 302 with the rotating body 306 rotatable with respect to the housing 302 (e.g., rotatable about the axis of the housing 302). The rotating body 306 also includes a bore 308 formed within and extending through the rotating body 306.

A packer assembly 310 is included within the rotating control device 300 to seal between the housing 302 and the rotating body 306. The packer assembly 310 is positioned within the bore 304 of the housing 302 between the housing 302 and the rotating body 306 with the packer assembly 310 sealing engaging the interior of the housing 302 and the exterior of the rotating body 306 to form a seal therebetween. The packer assembly 310 includes one or more packers 312 and one or more rings 314 positioned in between the packers 312 of the packer assembly 310. The packers 312 may be formed from or include an elastomeric material, such as natural or synthetic rubber, which includes hydrogenated nitrile butadiene rubber (HNBR). Further, the rings 314 may be formed from or include a non-metal material, such as a plastic or a polymer, which includes polytetrafluoroethylene (PTFE).

One or more sensors are included with the rotating control device 300 to facilitate monitoring the performance and operation of the rotating control device 300. For example, a sensor package 316 including one or more sensors is positioned within the housing 302 of the rotating control device 300, and more particularly positioned within the rotating body 306, to measure one or more properties related to the rotating control device 300. A sensor in accordance with the present disclosure may include a thermometer to measure the temperature within the rotating control device 300, a pressure gauge or transducer to measure the pressure within the rotating control device 300, an accelerometer to measure the vibration within or experienced by the rotating control device 300, a tachometer to measure the rotation of the rotating body 306 with respect to the housing 302 within the rotating control device 300, and/or any other type of sensor known in the art. The sensor may generate a sensor signal based upon the property measured by the signal. The sensor signal generated by the sensor within the rotating control device 300 is relayed or transmitted within the offshore drilling system to the offshore drilling platform or surface to review or monitor the operating conditions of the rotating control device 300. For example, the offshore drilling platform 202 in FIG. 2 may include a detector or similar equipment that receives the sensor signals from the rotating control device 300. The detector may be used to compare the sensor signals received from the rotating control device 300 with predetermined expected values to monitor the rotating control device 300. If a sensor value is outside an expected range (e.g., too high or too low), the detector may generate an alert that the rotating control device 300 is not working properly and that one or more components of the rotating control device 300 may need to be repaired or replaced.

With reference to FIGS. 5 and 6 still, to facilitate the transmission of the sensor signals, the rotating control device 300 may include one or more electronic components, such as a transmitter 320 and a receiver 330, to transmit the sensor signals from the rotating control device 300. As shown, the transmitter 320 is in communication with the sensor package 316 to receive the sensor signals from the sensor package 316.

In one or more embodiments, the transmitter 320 transmits the sensor signals through the packer assembly 310 to the receiver 330. For example, the transmitter 320 may transmit the sensor signals to the receiver 330 through one or more packers 312 or rings 314 of the packer assembly 310, as discussed more below, as opposed to other components of the rotating control device 300 positioned adjacent or axially above or below the packer assembly 310. As shown, the transmitter 320 and the receiver 330 are positioned on opposite sides of the packer assembly 310 to transmit signals across the packer assembly 310, such as by having the transmitter 320 positioned inside or within the packer assembly 310, and the receiver 330 positioned outside or exterior to the packer assembly 310. For example, the transmitter 320 and the receiver 330 (or at least portions thereof) may be positioned in radial alignment with each other and/or with the packer assembly 310. The transmitter 320, the receiver 330, and the packer assembly 310 may be positioned on the same radial plane that extends out from an axis of the bore 304 of the housing 302 for the transmitter 320, the receiver 330, and the packer assembly 310 to be in radial alignment with each other. In particular, signals may be transmitted across and received through a packer 312 of the packer assembly 310 by having the transmitter 320 and the receiver 330 positioned on opposite sides and in radial alignment with the packer 312 of the packer assembly 310. Signals may also be transmitted across and received through a ring 314 of the packer assembly 310 by having the transmitter 320 and the receiver 330 positioned on opposite sides and in radial alignment with the ring 314 of the packer assembly 310.

Referring still to FIG. 5, the transmitter 320 (or a portion thereof) may be positioned within the rotating body 306, such as within the bore 308 of the rotating body 306 or within the rotating body 306 itself, and the receiver 330 (or a portion thereof) may be positioned within the housing 302. For example, the transmitter 320 may include a transmitter antenna 322 positioned within a recess, bore, groove, or cavity 324 formed within the rotating body 306, and the receiver 330 may include a receiver antenna 332 positioned within a recess, bore, groove, or cavity 334 formed within the housing 302. In one embodiment, the groove 334 formed within the housing 302 may be an annular recess formed about the axis of the bore 304 of the housing 302. This may facilitate transmission of signals between the transmitter antenna 322 and the receiver antenna 332, independent of the rotational position of the transmitter antenna 322 with respect to the receiver antenna 332.

The transmitter 320 and the receiver 330 may communicate using radio frequency (RF) signals and technology. This configuration may prevent interference or corruption of the sensor signals. In particular, as the rotating control device 300 may be used offshore, fluids or other content (e.g., drilling muds and/or seawater) may be present within and surrounding components of the rotating control device 300. RF signals, however, may be disrupted in environments having areas with high salinity or metal content. Accordingly, in one or more embodiments, the signals may be transmitted through the packer assembly to prevent interference or corruption with the transmission of the signals.

In one or more embodiments, a wave guide may also be included within a rotating control device in accordance with the present disclosure to facilitate the transmission of signals within the rotating control device. For example, a wave guide may be positioned within the packer assembly 310 (such as between the packers 312 and/or the rings 314) such that signals may be transmitted across and received through the wave guide and the packer assembly 310. In one embodiment, the uppermost packer 312 in FIG. 5 may be replaced by a wave guide such that the signals may be transmitted through the wave guide and across the packer assembly 310.

Figure 7:
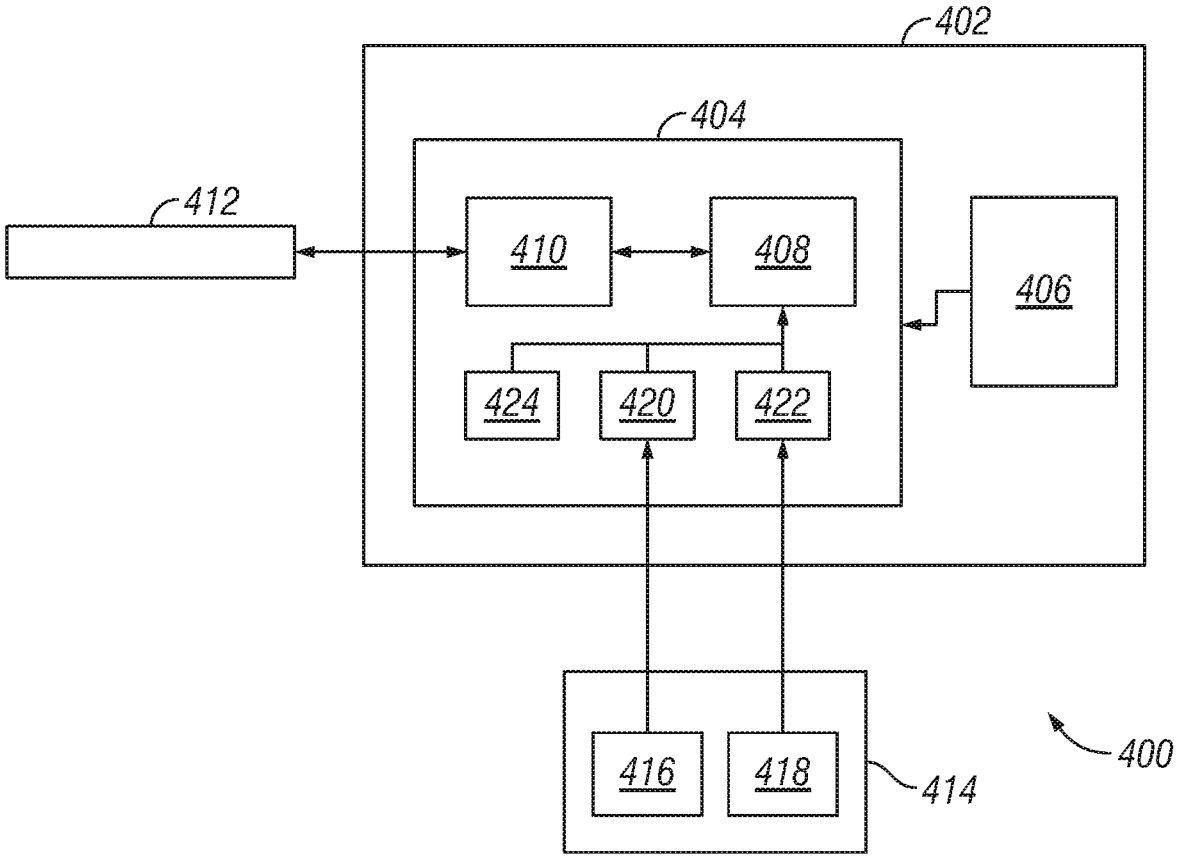
FIG. 7 depicts a schematic view of an example electronic component, according to one or more embodiments.

Further, in one or more embodiments, the transmitter 320 and/or the receiver 330 may include a transceiver such that one or both of the transmitter 320 and the receiver 330 may each transmit or receive signals. FIG. 7 shows a schematic view of an electronic component 400 or device in accordance with one or more embodiments, which may include or be used as the transmitter 320, the receiver 330, and/or a transceiver in FIG. 5. The component 400 includes an enclosure or housing 402 with a circuit board 404 and a battery 406 included within the enclosure 402. The battery 406 may be intrinsically safe and may be coupled to the circuit board 404 to provide power to the elements included on the circuit board 404. A controller 408 is included within the enclosure 402 and is connected to the circuit board 404.

A radio 410 may also be included within the enclosure 402 and connected to the circuit board 404 with an antenna 412 (e.g., Bulging 900 MHz Antenna) in communication with the controller 408 through the radio 410. A sensor package 414 including sensors 416 and 418 (e.g., thermometer and pressure gauge) may then be in communication with the controller 408 through amplifiers or chips 420 and 422 connected to the circuit board 404. Further, in one or more embodiments, a sensor 424 (e.g., accelerometer) may be included within the enclosure 402 of the electronic component 400 by being connected to the circuit board 404 and in communication with the controller 408.

As mentioned above, a detector may be included within an offshore drilling system to receive sensor signals from and monitor a rotating control device. Accordingly, in one or more embodiments, a communications module (e.g., gateway) may be used as the receiver 330. In such an embodiment, the communications module may receive the sensor signals from the transmitter 320 through the packer assembly 310, and then transmit the sensor signal to the detector. The communications module may include a transceiver to both receive and transmit the sensor signals. Alternatively, communications module may include a separate receiver and transmitter such that the receiver of the communications module receives the sensor signal from the transmitter (of the rotating body 306), and the transmitter of the communications module then transmits the sensor signal to the detector. When communicating within or between components of the rotating control device, RF signals may be used to communicate the signals. When communicating between the rotating control device and the offshore drilling platform, acoustic signals may be used to communicate the signals. However, one having ordinary skill in the art will appreciate that the scope of the present disclosure is not so limited, as the present disclosure contemplates using other types of signals and forms of communications to communicate the sensor signals and data. Further, the present disclosure mostly discusses one-way communication from the interior of the rotating control device to the exterior (e.g., from the transmitter 320, through the packer assembly 310, and to the receiver 330). However, the present disclosure is not so limited, as the rotating control device may be used within bi-directional communication as well and from the exterior of the rotating control device to the interior. For example, as discussed above, the transmitter 320 and the receiver 330 may be transceivers, in which signals may be communicated from the transceiver 330, through the packer assembly 310, and to the transceiver 320.

In addition to the embodiments described above, many examples of specific combinations are within the scope of the disclosure, some of which are detailed below:

Example 1

A rotating control device, comprising:
a housing comprising a bore extending through the housing;
a rotating body positioned within the bore of the housing and rotatable with respect to the housing;
a packer assembly positioned within the bore of the housing between the housing and the rotating body and configured to form a seal between the housing and the rotating body;
a transmitter configured to transmit a sensor signal through the packer assembly; and
a receiver configured to receive the sensor signal from the transmitter through the packer assembly.

Example 2

The device of Example 1, wherein at least a portion of the transmitter is positioned within the rotating body.

Example 3

The device of Example 2, wherein at least a portion of the receiver is positioned within the housing.

Example 4

The device of Example 3, wherein the portion of the transmitter and the portion of the receiver are positioned in radial alignment with the packer assembly.

Example 5

The device of Example 3, wherein the portion of the transmitter comprises a transmitter antenna.

Example 6

The device of Example 3, wherein the portion of the receiver comprises a receiver antenna.

Example 7

The device of Example 5, further comprising a recess formed within the housing about an axis of the bore of the housing, wherein the receiver antenna is positioned within the recess.

Example 8

The device of Example 3, wherein the packer assembly comprises a packer and a ring.

Example 9

The device of Example 8, wherein the portion of the transmitter and the portion of the receiver are positioned in radial alignment with the packer of the packer assembly such that the sensor signal is transmitted through the packer.

Example 10

The device of Example 8, wherein the portion of the transmitter and the portion of the receiver are positioned in radial alignment with the ring of the packer assembly such that the sensor signal is transmitted through the ring.

Example 11

The device of Example 1, further comprising a wave guide positioned within the packer assembly such that the sensor signal is transmitted through the wave guide.

Example 12

The device of Example 1, wherein:
the transmitter comprises a radio frequency (RF) transmitter;
the receiver comprises a RF receiver; and
at least one of the transmitter and the receiver comprises a transceiver.

Example 13

The device of Example 1, further comprising a sensor in communication with the transmitter and configured to generate the sensor signal, the sensor configured to measure temperature, pressure, or vibration within the rotating control device or rotation of the rotating body with respect to the housing.

Example 14

A method of monitoring a rotating control device within an offshore drilling system, comprising:
measuring a property related to the rotating control device and generating a sensor signal;
transmitting the sensor signal through a packer assembly of the rotating control device to an exterior of the rotating control device; and
transmitting the sensor signal to an offshore drilling platform.

Example 15

The method of Example 14, wherein the measuring the property comprises at least one of:
measuring temperature within the rotating control device;
measuring pressure within the rotating control device;
measuring vibration within the rotating control device; and
measuring rotation of a rotating body with respect to a housing of the rotating control device.

Example 16

The method of Example 14, wherein the transmitting the sensor signal through the packer assembly comprises at least one of:
transmitting the sensor signal through a packer of the packer assembly;
transmitting the sensor signal through a ring of the packer assembly; and
transmitting the sensor signal through a wave guide positioned within the packer assembly.

Example 17

The method of Example 14, wherein the transmitting the sensor signal through the packer assembly comprises transmitting a radio frequency (RF) sensor signal through the packer assembly with a RF transmitter and a RF receiver.

Example 18

The method of Example 14, wherein the transmitting the sensor signal to an offshore drilling platform comprises transmitting an acoustic sensor signal to the offshore drilling platform.

Example 19

An offshore drilling system, comprising:

an offshore drilling platform comprising a detector; and a riser assembly extending from the offshore drilling platform, the riser assembly comprising a rotating control device comprising:

a housing comprising a bore extending through the housing;

a rotating body positioned within the bore of the housing and rotatable with respect to the housing;

a packer assembly positioned within the bore of the housing between the housing and the rotating body and configured to form a seal between the housing and the rotating body;

a sensor configured to measure a property related to the rotating control device and generate a sensor signal;

a transmitter configured to communicate with the sensor to transmit the sensor signal through the packer assembly; and a communications module configured to receive the sensor signal from the transmitter through the packer assembly and transmit the sensor signal to the detector.

Example 20

The system of Example 19, wherein:

the communications module comprises a receiver and a second transmitter;

the receiver is configured to receive the sensor signal from the first transmitter; and the second transmitter is configured to transmit the sensor signal from the receiver to the detector.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A rotating control device, comprising:

a housing comprising a bore extending through the housing;

a rotating body positioned within the bore of the housing and rotatable with respect to the housing;

a packer assembly comprising an elastomeric packer and a non-metal ring positioned within the bore of the housing between the housing and the rotating body and the packer configured to form a seal between the housing and the rotating body;

a radio frequency (RF) transmitter configured to transmit a sensor signal through the packer assembly; and a RF receiver configured to receive the sensor signal from the transmitter through the packer assembly.

2. The device of claim 1, wherein at least a portion of the transmitter is positioned within the rotating body.

3. The device of claim 2, wherein at least a portion of the receiver is positioned within the housing.

4. The device of claim 3, wherein the portion of the transmitter and the portion of the receiver are positioned in radial alignment with the packer assembly.

5. The device of claim 3, wherein the portion of the transmitter comprises a transmitter antenna.

6. The device of claim 3, wherein the portion of the receiver comprises a receiver antenna.

7. The device of claim 6, further comprising a recess formed within the housing about an axis of the bore of the housing, wherein the receiver antenna is positioned within the recess.

8. The device of claim 3, wherein the portion of the transmitter and the portion of the receiver are positioned in radial alignment with the packer of the packer assembly such that the sensor signal is transmitted through the packer.

9. The device of claim 3, wherein the portion of the transmitter and the portion of the receiver are positioned in radial alignment with the ring of the packer assembly such that the sensor signal is transmitted through the ring.

10. The device of claim 1, further comprising a wave guide positioned within the packer assembly such that the sensor signal is transmitted through the wave guide.

11. The device of claim 1, wherein at least one of the transmitter or the receiver comprises a transceiver.

12. The device of claim 1, further comprising a sensor in communication with the transmitter and configured to generate the sensor signal, the sensor configured to measure temperature, pressure, or vibration within the rotating control device or rotation of the rotating body with respect to the housing.

13. A method of monitoring a rotating control device within an offshore drilling system, comprising:

measuring a property related to the rotating control device and generating a sensor signal;

transmitting the sensor signal as a radio frequency (RF) sensor signal through a packer assembly of the rotating control device to an exterior of the rotating control device using a RF transmitter and a RF receiver, the packer assembly comprising an elastomeric packer and a non-metal ring; and transmitting the sensor signal to an offshore drilling platform.

14. The method of claim 13, wherein the measuring the property comprises at least one of:

measuring temperature within the rotating control device;

measuring pressure within the rotating control device;

measuring vibration within the rotating control device; and measuring rotation of a rotating body with respect to a housing of the rotating control device.

15. The method of claim 13, wherein the transmitting the sensor signal through the packer assembly comprises at least one of:

transmitting the sensor signal through the packer of the packer assembly;

transmitting the sensor signal through the ring of the packer assembly;

transmitting the sensor signal through a wave guide positioned within the packer assembly.

16. The method of claim 13, wherein the transmitting the sensor signal to an offshore drilling platform comprises transmitting an acoustic sensor signal to the offshore drilling platform.

17. An offshore drilling system, comprising:

an offshore drilling platform comprising a detector; and a riser assembly extending from the offshore drilling platform, the riser assembly comprising a rotating control device comprising:

a housing comprising a bore extending through the housing;

a rotating body positioned within the bore of the housing and rotatable with respect to the housing;

a packer assembly positioned within the bore of the housing between the housing and the rotating body and comprising an elastomeric packer configured to form a seal between the housing and the rotating body;

a sensor configured to measure a property related to the rotating control device and generate a sensor signal;

a first radio frequency (RF) transmitter configured to communicate with the sensor to transmit the sensor signal through the packer assembly; and a communications module comprising a RF receiver configured to receive the sensor signal from the transmitter through the packer assembly and transmit the sensor signal to the detector.

18. The system of claim 17, wherein:

the communications module comprises a second transmitter;

the RF receiver is configured to receive the sensor signal from the first transmitter; and the second transmitter is configured to transmit the sensor signal from the RF receiver to the detector.

* * * * *